US011335291B2

(12) United States Patent
Kwak et al.

(10) Patent No.: US 11,335,291 B2
(45) Date of Patent: May 17, 2022

(54) DISPLAY CONTROLLER WITH MULTIPLE COMMON VOLTAGES CORRESPONDING TO MULTIPLE REFRESH RATES

(71) Applicant: Intel Corporation, Santa Clara, CA (US)

(72) Inventors: Dongyeung Kwak, San Jose, CA (US); Ramon C. Cancel Olmo, Hillsboro, OR (US); Jue Li, Shanghai (CN); Thomas A. Nugraha, Tokyo (JP); John Lang, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/313,401

(22) PCT Filed: Jul. 1, 2016

(86) PCT No.: PCT/CN2016/088085
§ 371 (c)(1),
(2) Date: Dec. 26, 2018

(87) PCT Pub. No.: WO2018/000407
PCT Pub. Date: Jan. 4, 2018

(65) Prior Publication Data

US 2019/0244576 A1 Aug. 8, 2019

(51) Int. Cl.
*G09G 3/36* (2006.01)

(52) U.S. Cl.
CPC ..... *G09G 3/3655* (2013.01); *G09G 3/3614* (2013.01); *G09G 2310/08* (2013.01);
(Continued)

(58) Field of Classification Search
CPC ..... G09G 2320/0247; G09G 3/3655; G09G 3/3614; G09G 2320/0252; G09G 2370/08; G09G 2340/0435; G09G 2310/08
See application file for complete search history.

(56) References Cited

U.S. PATENT DOCUMENTS 5,168,270 A * 12/1992 Masumori ..... G09G 3/2011 345/100
6,104,367 A * 8/2000 McKnight ..... G09G 3/2011 345/103
(Continued)

FOREIGN PATENT DOCUMENTS

CN 102053412 A 5/2011
CN 104376820 A 2/2015
(Continued)

OTHER PUBLICATIONS

International Search Report and Written Opinion for International Patent Application No. PCT/CN2016/088085, dated Mar. 30, 2017, 12 pages.
(Continued)

*Primary Examiner* — Michael J Jansen, II
(74) *Attorney, Agent, or Firm* — Jordan IP Law, LLC

(57) ABSTRACT

A display controller for a display may include a frame rate circuit to change a frame rate of the display from a first frame rate to a second frame rate, and a reference voltage circuit to adjust a reference voltage of the display from a first reference voltage corresponding to the first frame rate to a second reference voltage corresponding to the second frame rate. The display may be a thin film transistor liquid crystal display. The reference voltage may correspond to a common voltage (Vcom) for the display.

18 Claims, 7 Drawing Sheets

(52) U.S. Cl.
CPC ..... *G09G 2320/0247* (2013.01); *G09G 2320/0252* (2013.01); *G09G 2340/0435* (2013.01); *G09G 2370/08* (2013.01)

(56) References Cited

U.S. PATENT DOCUMENTS 6,801,220 B2 * 10/2004 Greier ..... G09G 3/3611 345/694
7,859,503 B2 * 12/2010 Sasaki ..... G09G 3/3648 345/87
7,893,908 B2 * 2/2011 Morimoto ..... G09G 3/3648 345/94
7,990,363 B2 * 8/2011 Tseng ..... G09G 3/3614 345/103
8,144,141 B2 * 3/2012 Hirose ..... G09G 3/3648 345/209
8,599,193 B2 * 12/2013 Kim ..... G09G 3/3648 345/214
8,922,532 B2 * 12/2014 Choi ..... G09G 5/005 345/204
9,208,744 B2 * 12/2015 Fukunaga ..... G09G 3/3406
9,214,123 B2 * 12/2015 Sato ..... G02F 1/133
9,318,069 B2 * 4/2016 Nambi ..... G09G 3/36
9,501,993 B2 * 11/2016 Nambi ..... G09G 3/36
9,786,236 B2 * 10/2017 Chen ..... G09G 3/3614
9,818,364 B2 * 11/2017 Lee ..... G09G 3/3648
9,830,032 B2 * 11/2017 Small ..... G06F 3/044
10,056,025 B2 * 8/2018 Jo ..... G09G 5/18
10,056,050 B2 * 8/2018 Nambi ..... G09G 3/3611
10,152,929 B2 * 12/2018 Chen ..... G02F 1/13439
10,229,644 B2 * 3/2019 Noichi ..... G09G 3/3655
10,269,316 B2 * 4/2019 Sakurai ..... G09G 3/3648
2002/0149598 A1 * 10/2002 Greier ..... G09G 3/3611 345/589
2006/0066544 A1 * 3/2006 Sasaki ..... G09G 3/3648 345/87
2007/0262940 A1 * 11/2007 Morimoto ..... G09G 3/3648 345/94
2008/0266217 A1 * 10/2008 Kim ..... G09G 3/3655 345/87
2009/0237340 A1 * 9/2009 Park ..... G09G 3/2092 345/90
2010/0079429 A1 * 4/2010 Hirose ..... G09G 3/3426 345/209
2011/0025680 A1 2/2011 Kim et al.
2011/0058024 A1 3/2011 Ota
2011/0109666 A1 * 5/2011 Owa ..... G09G 3/3648 345/690
2013/0033464 A1 2/2013 Choi et al.
2013/0265345 A1 * 10/2013 Krig ..... G09G 3/36 345/690
2014/0198093 A1 * 7/2014 Nambi ..... G09G 3/36 345/212
2014/0198114 A1 * 7/2014 Nambi ..... G09G 3/36 345/522
2014/0198138 A1 * 7/2014 Nambi ..... G09G 3/36 345/690
2016/0063914 A1 3/2016 Lee et al.
2017/0162139 A1 * 6/2017 Chen ..... G09G 3/3275
2017/0186382 A1 * 6/2017 Chen ..... G09G 3/3607
2017/0249892 A1 * 8/2017 Jo ..... G09G 5/18
2017/0287419 A1 * 10/2017 Noichi ..... G09G 3/3614
2018/0040285 A1 * 2/2018 Sakurai ..... G09G 3/3648
2021/0110777 A1 * 4/2021 Shintani ..... G09G 5/363

FOREIGN PATENT DOCUMENTS

CN 105390082 A 3/2016
KR 20070094376 A 9/2007
TW 201312537 A 3/2013

OTHER PUBLICATIONS

Decision of Rejection for Chinese Patent Application No. 2022021602217240, dated Feb. 21, 2022, 12 pages including 5 pages of English translation.
Decision of Rejection for Chinese Patent Application No. 201680086557.9, dated Feb. 21, 2022, 12 pages including 5 pages of English translation.

* cited by examiner

DISPLAY CONTROLLER WITH MULTIPLE COMMON VOLTAGES CORRESPONDING TO MULTIPLE REFRESH RATES

CROSS REFERENCE TO RELATED APPLICATIONS

This application is a U.S. National Phase Patent Application which claims benefit to International Patent Application No. PCT/CN2016/088085 filed on Jul. 1, 2016.

TECHNICAL FIELD

Embodiments generally relate to display controllers. More particularly, embodiments relate to display controllers for displays operating at a refresh rate and driving pixels around a common voltage.

BACKGROUND

Thin film transistor (TFT)—liquid crystal display (LCD) displays generally include a pixel array that is driven by positive and negative pixel voltages relative to a common voltage (Vcom). Display artifacts such a flickering may occur due to a pixel voltage unbalance between positive and negative polarities between frame images. The use of oxide TFT backplanes to reduce leakage current may be one approach to minimize this pixel voltage unbalance. Oxide backplanes, however, generally require higher development and manufacturing costs.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1:
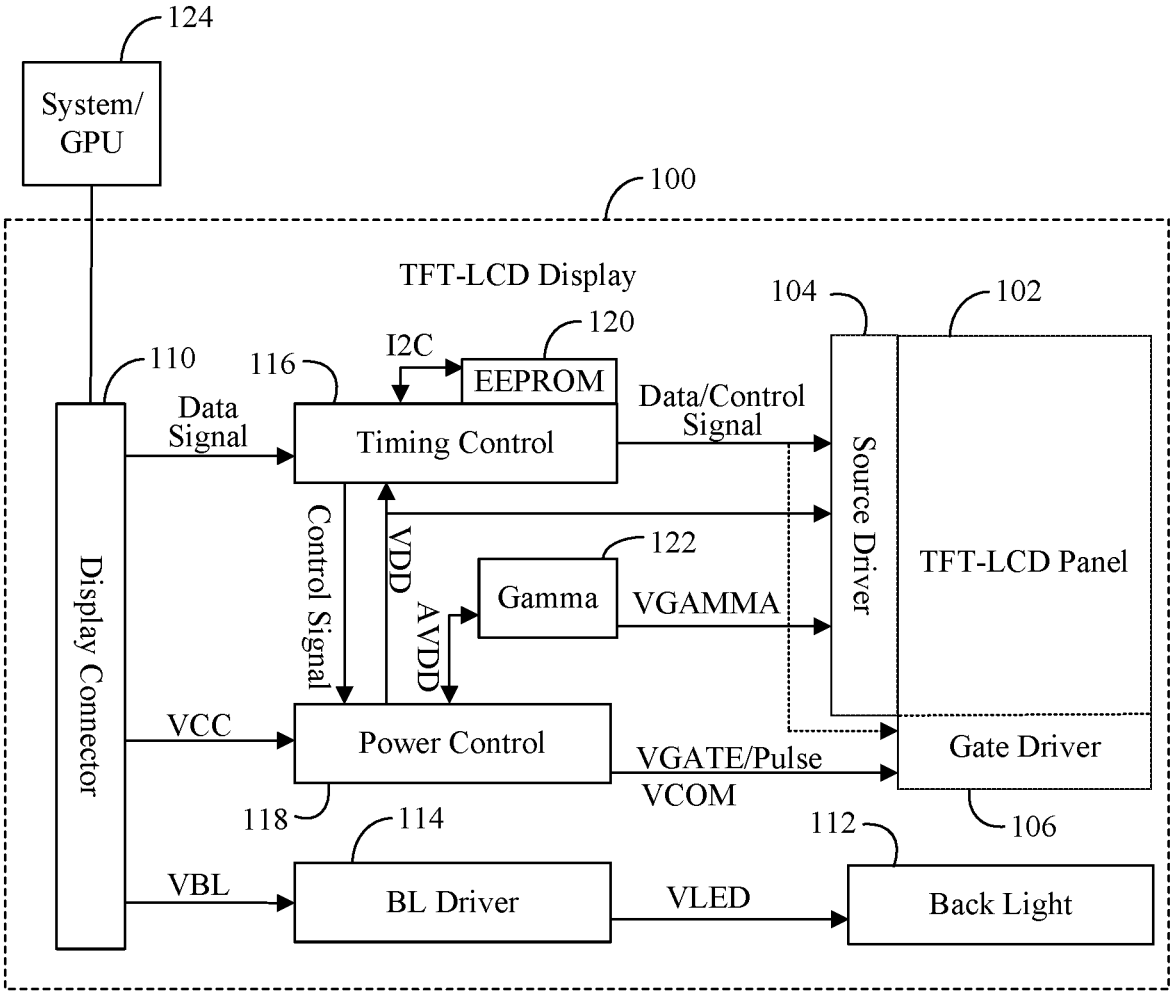
FIG. 1 is a block diagram of an example of a display system according to an embodiment.

Embodiments of a liquid crystal display system may include a liquid crystal to display panel, a source driver circuit coupled to the liquid crystal display panel, and a gate driver circuit coupled to the liquid crystal display panel. The liquid crystal display system may further include a display connector, a back light disposed adjacent to the liquid crystal display panel, and a back light driver circuit coupled between the display connector and the back light. The liquid crystal display system may further include a timing control circuit coupled between the display connector and the source driver circuit, the timing control circuit to set a frame rate of the liquid crystal display panel to one of at least a first frame rate and a second frame rate in accordance with an operation mode. The liquid crystal display system may further include a power control circuit coupled between the display connector and the gate driver circuit. Advantageously, the power control circuit may set a reference voltage of the liquid crystal display panel to one of at least a first reference voltage and a second reference voltage in accordance with the operation mode.

For example, the first reference voltage may correspond to a first pre-determined voltage for the first frame rate and the second reference voltage may correspond to a second pre-determined voltage for the second frame rate. An embodiment of the liquid crystal display system may further include a non-volatile memory storing at least a first value which correlates the first reference voltage with the first frame rate and at least a second value which correlates the second reference voltage with the second frame rate. For example, the timing control circuit may include a frame rate circuit to set a different frame rate for the liquid crystal display to one of the first frame and the second frame rate in accordance with a change in the operation mode, to retrieve one of the first value and the second value from the non-volatile memory in accordance with the different frame rate, and to provide the retrieved value to the power control circuit. For example, the first reference voltage may correspond to a voltage which provides reduced flicker at the first frame rate and the second reference voltage may correspond to a voltage which provides reduced flicker at the second frame rate.

For example, a 60 Hz frame rate may be a standard display refresh rate. Low frame rate driving comparatively may be a method to save power consumption in TFT-LCD displays. When frame rate is lowered (e.g. down to 40 Hz, 30 Hz, etc.), the most dominant artifact symptom in a TFT-LCD display may be flickering due to pixel voltage unbalance between positive and negative polarities in each frame image. One approach to minimize this pixel voltage unbalance may be to reduce TFT leakage current. This approach, however, may require relatively complex development and increased manufacturing cost. For example, an oxide TFT backplane may reduce leakage current in a TFT-LCD display with a corresponding increase in design complexity and manufacturing cost.

Advantageously, an embodiment may reduce display image degradation in a TFT-LCD display without the need to reduce leakage current. Advantageously, an embodiment may reduce flicker in a TFT-LCD display by adjusting the common voltage to improve the pixel voltage balance when the frame rate is changed. Advantageously, an embodiment may provide multiple Vcom voltage values, with a pre-determined Vcom for each different frame rate. For example, by adjusting Vcom properly in accordance with a lower frame rate (40 Hz, 30 Hz, etc.) versus 60 Hz, the positive and negative pixel voltages may become well balanced. Advantageously, in an embodiment display power consumption may be reduced by using low frame rate driving without image quality degradation like flickering.

Turning now to FIG. 1, embodiments of a liquid crystal display system 100 include a thin film transistor (TFT)-liquid crystal display (LCD) panel 102, a source driver circuit 104 coupled to the TFT-LCD panel 102, and a gate driver circuit 106 coupled to the TFT-LCD panel 102. The display system 100 further includes a display connector 110, a back light 112 disposed adjacent to the TFT-LCD panel 102, and a back light driver circuit 114 coupled between the display connector 110 and the back light 112. The display system 100 further includes a timing control circuit 116 coupled between the display connector 110 and the source driver circuit 104, the timing control circuit 116 to set a frame rate of the TFT-LCD panel 102 to one of at least a first frame rate and a second frame rate in accordance with an operation mode. The illustrated display system 100 further includes a power control circuit 118 coupled between the display connector 110 and the gate driver circuit 106, the power control circuit 118 to set a reference voltage of the TFT-LCD panel 102 to one of at least a first reference voltage and a second reference voltage in accordance with the operation mode. The display system 100 may further include a gamma circuit 122 coupled between the power control circuit 118 and the source driver circuit 104.

For example, the first reference voltage may correspond to a first pre-determined voltage for the first frame rate and the second reference voltage may correspond to a second pre-determined voltage for the second frame rate. An embodiment of the display system 100 may further include a non-volatile memory 120 (e.g. a EEPROM) storing at least a first value which correlates the first reference voltage with the first frame rate and at least a second value which correlates the second reference voltage with the second frame rate. For example, the timing control circuit 116 may include a frame rate circuit to set a different frame rate for the liquid crystal display panel 102 to one of the first frame and the second frame rate in accordance with a change in the operation mode, to retrieve one of the first value and the second value from the non-volatile memory 120 in accordance with the different frame rate, and to provide the retrieved value to the power control circuit 118. For example, the first reference voltage may correspond to a first common voltage (Vcom1) which provides reduced flicker at the first frame rate and the second reference voltage may correspond to a second common voltage (Vcom2) which provides reduced flicker at the second frame rate.

For example, the display system 100 may receive a first control signal from a processing system or graphics processing unit (GPU) 124 which indicates the desired operation mode for the display. The timing control circuit 116 may be responsive to the first control signal to set a new frame rate based on the first control signal and to retrieve a value from the non-volatile memory 120 which indicates a reference voltage corresponding to either the new frame rate or the operation mode indicated by the first control signal. The timing control circuit 116 may provide a second control signal to the power control circuit 118. The power control circuit 118 may be responsive to the second control signal to set a new reference voltage.

Given the benefit of the present specification, claims, and drawings, those skilled in the art will understand that numerous alternative configurations for circuits, logic, and control signals may be adapted to achieve the desired result of changing the frame rate of the display system 100 with a correlated change to the reference voltage. For example, the non-volatile memory 120 may be alternatively associated with the power control circuit 118, with the first control signal provided to the power control circuit 118 to set the desired reference voltage based on the operation mode indicated by the first control signal and the power control circuit 118 may provide the second control signal to the timing control circuit 116 to set the desired frame rate based on the second control signal. In another example embodiment, both the timing control circuit 116 and the power control circuit 118 may include their own respective non-volatile memories and may independently receive the first control signal from the GPU and thereafter set the correlated frame rate and reference voltage based on the first control signal in accordance with the indicated operating mode.

Advantageously, various embodiments of the display system 100 may exhibit reduced display artifacts when switching between operation modes. For example, an embodiment may solve a flickering problem which may occur when using a low frame rate in the TFT-LCD display to save display power consumption. For example, power consumption in the display may be an important technical specification to extend the battery time in a portable device such as a mobile phone, a tablet, a phablet, a 2-in-1 computer, a convertible computer, and/or a laptop computer. Likewise, power consumption may also be important in an external display for a desktop computer system, or an all-in-one computer system.

For example, when switching to a low power mode, the frame rate of a display may be reduced from 60 Hz to 40 Hz to reduce power consumption. In some conventional systems, reducing the frame rate to 40 Hz may result in observable flicker in the display. In accordance with an embodiment, the display system 100 may advantageously change the reference voltage from a common voltage provided at 60 Hz (Vcom60) to a different common voltage which exhibits no visually perceptible flicker at 40 Hz (Vcom40) while operating in the low power mode.

Figure 2A:
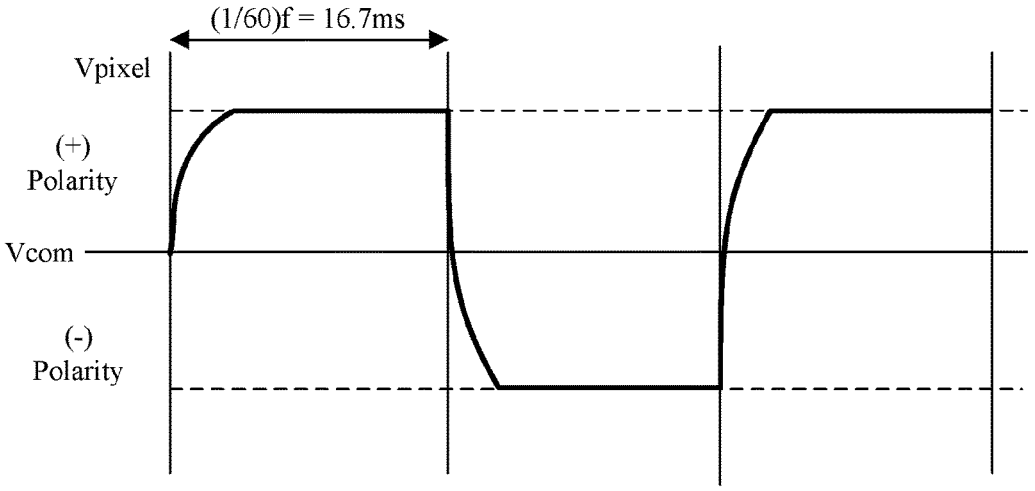
FIG. 2A is an illustrative graph of an example of a pixel voltage at 60 Hz.
Figure 2B:
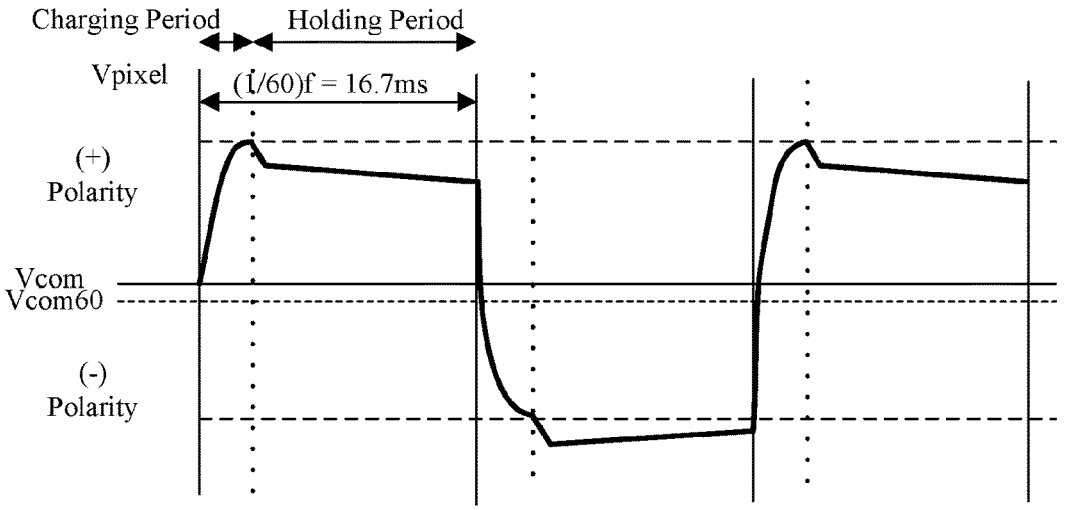
FIG. 2B is another illustrative graph of an example of a pixel voltage at 60 Hz according to an embodiment.
Figure 2C:
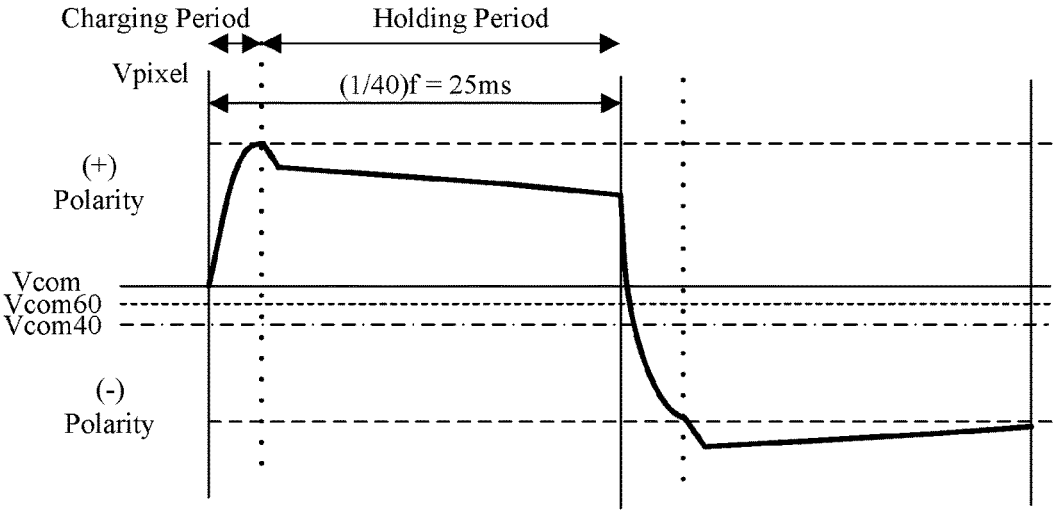
FIG. 2C is an illustrative graph of an example of a pixel voltage at 40 Hz according to an embodiment.

Without being limited to principle of operation, an embodiment may be understood with reference to the illustrative graphs of FIGS. 2A, 2B, and 2C. In general, a TFT-LCD display rotates liquid crystal with plus (+) and minus (−) pixel voltage polarities to prevent image sticking in the screen due to the residual direct current (DC) ingredient. A common voltage (Vcom) may be determined to balance the plus and minus polarities and to reduce or remove any residual DC ingredient in the TFT-LCD panel.

With reference to FIG. 2A, an illustrative example of an ideal TFT-LCD pixel driving voltage is depicted at 60 Hz without regard to any parasitic effects. For example, Vcom (a common voltage or a reference voltage) may be exactly in the middle of the plus and minus polarities to balance the plus and minus pixel voltage (Vpixel) polarities.

With reference to FIG. 2B, an illustrative example of a practical TFT-LCD pixel driving voltage is depicted at 60 Hz, taking parasitic effects into account. For example, when considering TFT-LCD display process and design capability for manufacturing, plus and minus pixel voltages may become unbalanced due to unintended effects such as kick-back voltage ($\Delta Vp$) and leakage current ($I_{leakage}$) during the holding period. For example, in FIG. 2B these effects may be illustrated by the space between the dashed lines at the plus and minus polarities and the solid line representing the driving voltage Vpixel. This pixel voltage difference between plus and minus polarities may cause a transmittance difference resulting in a flickering symptom in a TFT-LCD display. To prevent this flickering issue, a new common voltage (Vcom60) may be determined at the 60 Hz frame rate to symmetrically balance the total amount of plus and minus pixel voltage polarities. The new common voltage Vcom60 may be different from the ideal common voltage Vcom. Flickering may be reduced or removed at the reference voltage Vcom60 as compared to Vcom when the display is operating at a frame rate of 60 Hz.

With reference to FIG. 2C, an illustrative example of a practical TFT-LCD pixel driving voltage is depicted at 40

Hz, taking parasitic effects into account. When the frame rate is switched from 60 Hz to 40 Hz, one frame rate period is extended from 16.7 ms (60 Hz) to 25 ms (40 Hz). For example, the charging period is less than about 15.4 usec in full high definition (FHD) 1920×1080 resolution at 60 Hz and the majority of time during one frame rate period is in the holding period. Accordingly, total leakage current in one frame rate period at a 40 Hz frame rate may be more than the total leakage current in one frame rate period at a 60 Hz frame rate due to the relatively longer holding period at the 40 Hz frame rate. If the common voltage is set to Vcom60 during 60 Hz frame rate driving and remains at Vcom60 when the frame rate switches from 60 Hz to 40 Hz, the pixel voltage amounts of plus and minus polarities at 40 Hz become different as compared to 60 Hz. This difference may make flickering worse at 40 Hz as compared to 60 Hz, when the common voltage is at Vcom60. Advantageously, an embodiment determine a new common voltage Vcom40 which provides reduced flicker at 40 Hz and set the common voltage of the display to the new common voltage Vcom40 when the frame rate is set to 40 Hz.

As noted above, one approach to the low frame rate driving is reducing leakage current as might be provided, for example, by an oxide TFT backplane. This oxide technology, however, may require increased development time and generally requires more photo mask steps and consequentially increased manufacturing costs. Advantageously, an embodiment of a display system may avoid extra development time, photo mask steps, and/or manufacturing costs associated with an oxide TFT backplane by determining a different Vcom for each different frame rate of the display system that provides reduced flicker for each pair of corresponding frame rates and Vcom voltage values. For example, an optimal or most acceptable Vcom may be determined for each frame rate and stored in the display system such that the optimal or most acceptable Vcom can be recalled and applied to the display system when the frame rate changes. An embodiment may provide a silicon TFT-LCD that can switch to a low frame rate without noticeable flicker to save panel power consumption instead of the more expensive low leakage current oxide TFT backplane technology.

Figure 3:
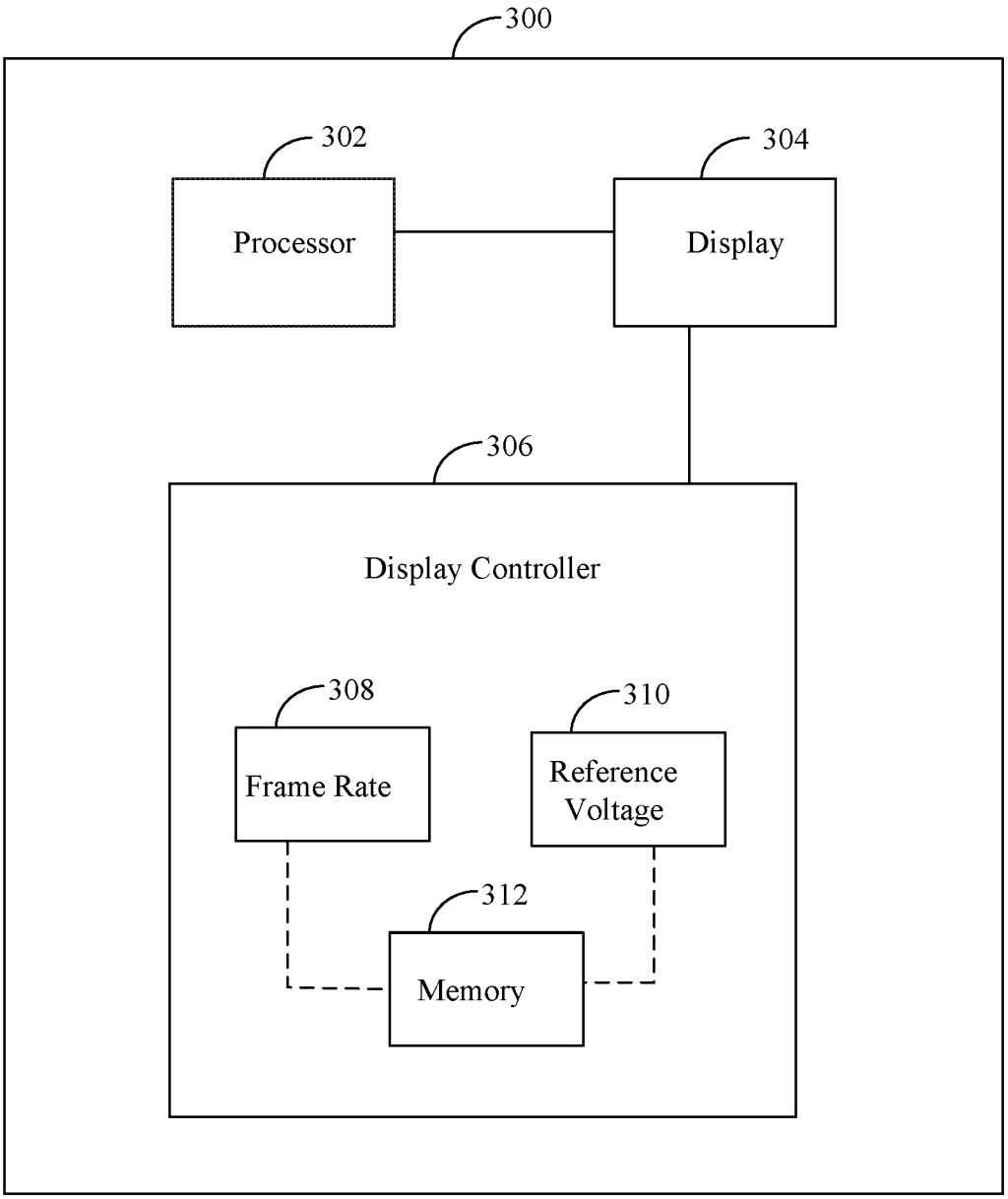
FIG. 3 is a block diagram of an example of a processing system according to an embodiment.

Turning to FIG. 3, embodiments of a processing system 300 include a processor 302, a display 304 coupled to the processor 302, and a display controller 306 coupled to the display 304. The display controller 306 includes a frame rate circuit 308 to change a frame rate of the display 304 from a first frame rate to a second frame rate, and a reference voltage circuit 310 to adjust a reference voltage of the display 304 from a first reference voltage corresponding to the first frame rate to a second reference voltage corresponding to the second frame rate. For example, an embodiment of the display controller 306 may further include a memory 312 storing a first value which correlates the first reference voltage with the first frame rate in a first memory location and a second value which correlates the second reference voltage with the second frame rate in a second memory location. For example, the first reference voltage may correspond to a voltage which provides reduced flicker at the first frame rate and the second reference voltage may correspond to a voltage which provides reduced flicker at the second frame rate.

In an embodiment of the processing system 300 the frame rate circuit 308 is further to change the frame rate of the display 304 from the first frame rate to the second frame rate in accordance with a change in an operation mode and the reference voltage circuit 310 is further to adjust the reference voltage of the display 304 from the first reference voltage to the second reference voltage in accordance with the change in the operation mode. For example, the change in the operation mode may correspond to a change in a power mode.

In an embodiment of the processing system 300 the frame rate circuit 308 is further to change the frame rate of the display 304 from the first frame rate to a third frame rate, and the reference voltage circuit 310 is further to adjust the reference voltage of the display 304 from the first reference voltage corresponding to the first frame rate to a third reference voltage corresponding to the third frame rate. For example, the display 304 may include a liquid crystal display and the reference voltage may correspond to a common voltage for the liquid crystal display.

Non-limiting examples of a processing system 300 include a smart watch, a phone, a tablet, a phablet, a 2-in-1 computer, a convertible computer, a laptop computer, a desktop computer, and an all-in-one computer. Non-limiting examples of a processor 302 include a general purpose processor, a special purpose processor, a central processing unit (CPU), and a graphics processing unit (GPU).

Non-limiting examples of an operation mode for the processing system 300 include a regular mode, a power mode, a gaming mode, a performance mode, a movie mode, a user selected mode, and a condition triggered mode. For example, a regular mode may correspond to a 60 Hz refresh rate. A power mode may include a high power mode with a 120 Hz refresh rate, a regular power mode with a 60 Hz refresh rate, and a low power mode with a 30 Hz refresh rate. A gaming mode may correspond to a 120 Hz refresh rate. For example, higher frequency sync for gaming may provide smoother video. A performance mode may correspond to a 120 Hz refresh rate. A movie mode may include any of a 24 Hz, 30 Hz, 48 Hz, and a 60 Hz refresh rate, based on a multiple of a frame rate of the source video (e.g. 1×, 2×, etc.; a 24 fps video corresponding to a 48 Hz refresh rate). A user selected mode may correspond to any refresh rate the user prefers, or may correspond to another mode (e.g. a gaming mode or a movie mode) selected in response to a user input. For example, a user may prefer to watch video at a frame rate which reduces perceived juddering. A condition triggered mode corresponds to any mode set by another condition, such as a user input timeout triggering a low power mode. For example, a condition triggered mode may correspond to a utility company sending a power reduction request (e.g. for a rolling brown-out) over a wired or wireless network to a desktop computer, triggering the external display to operate at a lower frame rate to reduce power consumption.

Figure 4:
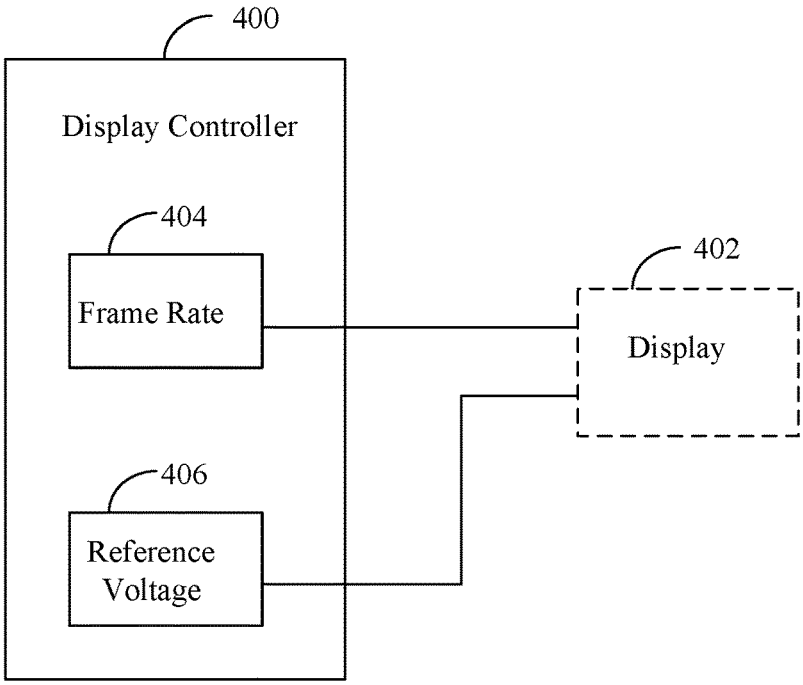
FIG. 4 is a block diagram of an example of a display controller according to an embodiment.

Turning to FIG. 4, embodiments of a display controller 400 for a display 402 may include a frame rate circuit 404 to change a frame rate of the display 402 from a first frame rate to a second frame rate, and a reference voltage circuit 406 to adjust a reference voltage of the display from a first reference voltage corresponding to the first frame rate to a second reference voltage corresponding to the second frame rate. For example, the first reference voltage may correspond to a voltage which provides reduced flicker at the first frame rate and the second reference voltage may correspond to a voltage which provides reduced flicker at the second frame rate.

In an embodiment of the display controller 400, the frame rate circuit 404 is further to change the frame rate of the display 402 from the first frame rate to the second frame rate in accordance with a change in an operation mode and the reference voltage circuit 406 is further to adjust the reference voltage of the display 404 from the first reference voltage to the second reference voltage in accordance with the change in the operation mode. For example, the change in the operation mode may correspond to a change in a power mode. In an embodiment of the display controller 400, the frame rate circuit 404 is further to change the frame rate of the display 402 from the first frame rate to a third frame rate, and the reference voltage circuit 406 is further to adjust the reference voltage of the display 402 from the first reference voltage corresponding to the first frame rate to a third reference voltage corresponding to the third frame rate.

Figure 5:
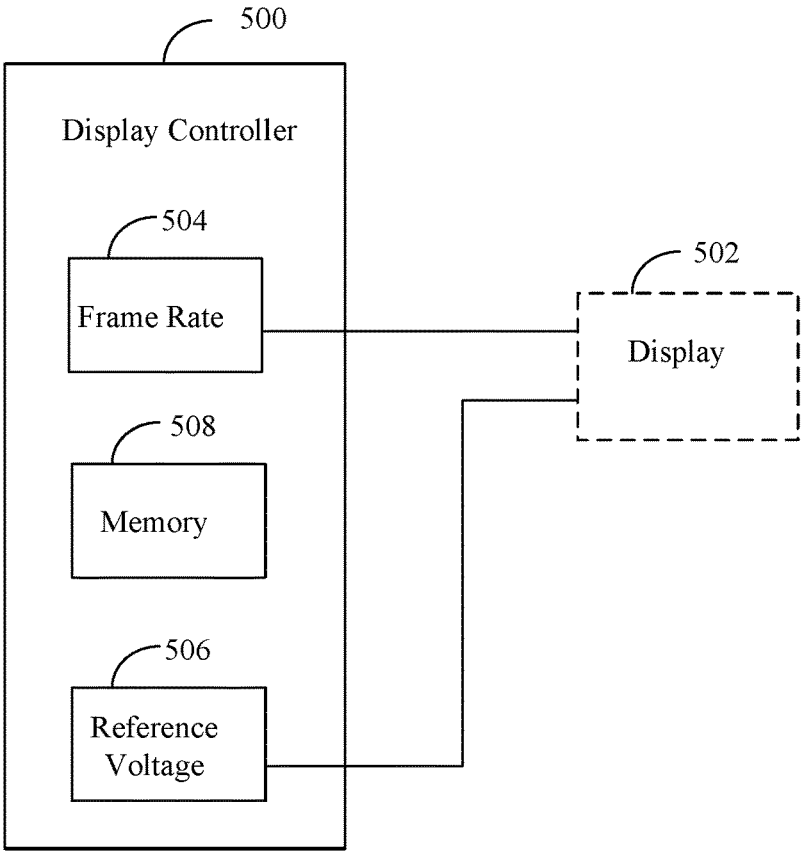
FIG. 5 is a block diagram of an example of another display controller according to an embodiment.

Turning to FIG. 5, embodiments of a display controller 500 for a display 502 may include a frame rate circuit 504 to change a frame rate of the display 502 from a first frame rate to a second frame rate, and a reference voltage circuit 506 to adjust a reference voltage of the display from a first reference voltage corresponding to the first frame rate to a second reference voltage corresponding to the second frame rate. For example, embodiments of the display controller 500 may further include a memory 508 storing a first value which correlates the first reference voltage with the first frame rate in a first memory location, and a second value which correlates the second reference voltage with the second frame rate in a second memory location. For example, the first reference voltage may correspond to a voltage which provides reduced flicker at the first frame rate and the second reference voltage may correspond to a voltage which provides reduced flicker at the second frame rate.

In an embodiment of the display controller 500, the frame rate circuit 504 is further to change the frame rate of the display 502 from the first frame rate to the second frame rate in accordance with a change in an operation mode and the reference voltage circuit 506 is further to adjust the reference voltage of the display 502 from the first reference voltage to the second reference voltage in accordance with the change in the operation mode. For example, the change in the operation mode may correspond to a change in a power mode. In an embodiment of the display controller 500, the frame rate circuit 504 is further to change the frame rate of the display 502 from the first frame rate to a third frame rate, and the reference voltage circuit 506 is further to adjust the reference voltage of the display 502 from the first reference voltage corresponding to the first frame rate to a third reference voltage corresponding to the third frame rate.

For example, the frame rate circuit 504 may include a display vertical and horizontal sync circuit coupled to a clock circuit, wherein the clock circuit includes a settable clock divider circuit in which the output of the clock divider circuit may be set to different frequencies by controlling switches in the clock divider circuit. Moreover, the clock circuit may be adjustable through a range of frequencies that provide a desired range of refresh rates (e.g. from 24 Hz to 120 Hz). Alternatively, the frame rate circuit 504 may be part of a graphics processing unit (GPU) that is configured to provide different clock signals corresponding to the desired frame rates.

For example, the reference voltage circuit 506 may include a digital to analog (D/A) circuit which is biased to adjust through a range of voltages covering at least the range of desired Vcom voltage values (e.g. a range of 2 volts to 4 volts). The digital input to the D/A is effective to select a desired output voltage. For example, the digital input value for the D/A corresponding to a Vcom60 voltage output (e.g. a first reference voltage) may be stored in a first memory location of the memory 508 and the digital input value for the D/A corresponding to a Vcom40 voltage output (e.g. a second reference voltage) may be stored in a second memory location of the memory 508. When the frame rate circuit 504 changes the frame rate from the first frame rate to the second frame rate (e.g. from 60 Hz to 40 Hz), the digital value stored in the second memory location may be recalled from the memory 508 and provided to the reference voltage circuit 506 as an input to the D/A circuit to provide the desired common voltage to the display (e.g. Vcom40). Alternatively, a discrete voltage divider circuit may provide various reference voltage outputs set by controlling switches in the voltage divider circuit.

In an embodiment, the memory 508 may include at least one non-volatile memory storing at least one look-up table with table entries and indices to correlate at least two of the frame rate, the reference voltage, and the operation mode.

Figure 6A:
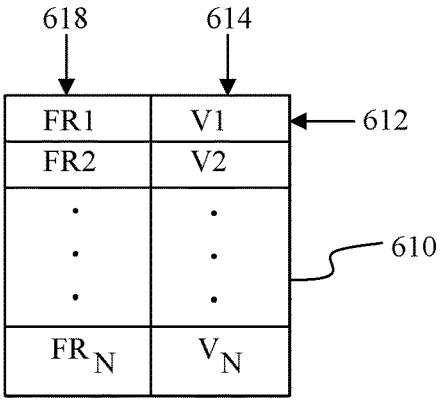
FIGS. 6A-6E are block diagrams of examples of look-up tables according to embodiments.

With reference to FIG. 6A, in one example a look-up table 610 stored in the memory 508 includes table entries 612 (entry 1 through N) that contain values 614 that represent respective reference voltages (V1 through $V_N$). The table 610 may be indexed by indices 618 representing respective frame rates (FR1 through $FR_N$). In this example, the frame rate circuit 504 may include a circuit to set a different frame rate (e.g. FR2=50 Hz) for the liquid crystal display in accordance with a corresponding operation mode, to retrieve a value representing the correlated reference voltage (e.g. V2 corresponding to Vcom50) from the look-up table 610 in accordance with the frame rate index, and to provide the retrieved value or correlated reference voltage to the reference voltage circuit 506.

Figure 6B:
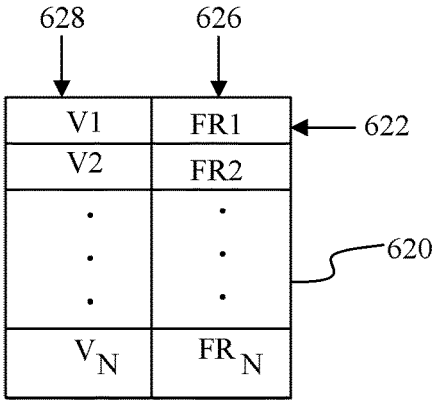

With reference to FIG. 6B, in another example a look-up table 620 stored in the memory 508 includes table entries 622 (entry 1 through N) that contain values 626 that represent respective frame rates (FR1 through $FR_N$). The table 620 may be indexed by indices 618 representing reference voltages (V1 through $V_N$). In this example, the reference voltage circuit 506 may include a circuit to set a different reference voltage (e.g. V2=Vcom50) for the liquid crystal display in accordance with a corresponding operation mode, to retrieve a value representing the correlated frame rate (e.g. FR2 corresponding to 50 Hz) from the look-up table 620 in accordance with the reference voltage index, and to provide the retrieved value or correlated frame rate to the frame rate circuit 504.

Figure 6C:
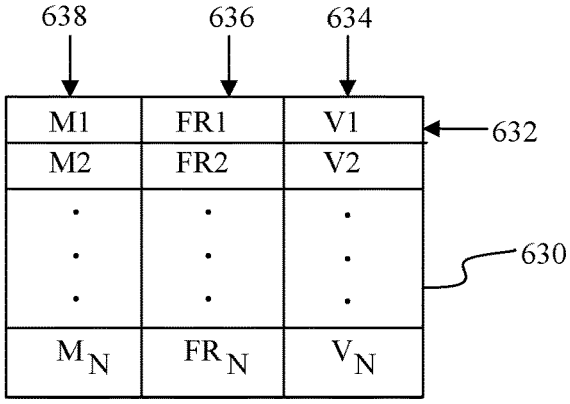

With reference to FIG. 6C, in another example a look-up table 630 stored in the memory 508 includes table entries 632 (entry 1 through N) that contain values 626 that represent frame rates (FR1 through $FR_N$ in one portion of the table entry) and corresponding values 624 that represent reference voltages (V1 through $V_N$ in another portion of the table entry). The table 630 may be indexed by indices 638 representing operation modes (M1 through $M_N$). In this example, the frame rate circuit 504 may include a circuit to retrieve a value representing the corresponding frame rate (e.g. FR2) from the look-up table 630 in accordance with the operation mode index (e.g. M2) and to set the frame rate accordingly, and the reference voltage circuit 506 may include a circuit to retrieve a value representing the corresponding reference voltage (e.g. V2) from the look-up table 630 in accordance with the operation mode index (e.g. M2) and to set the reference voltage accordingly.

Figure 6D:
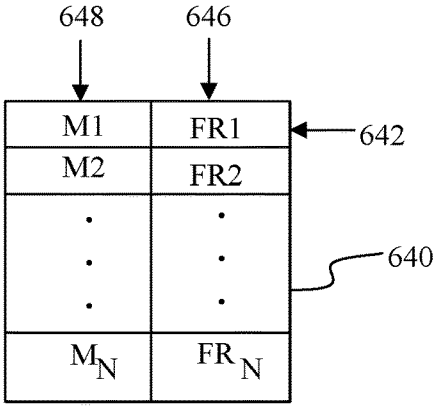
Figure 6E:
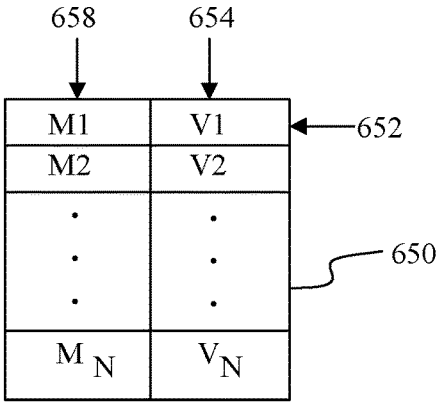

In another example of look-up tables stored in the memory 508, each of the frame rate circuit 504 and reference voltage circuit 506 has its own local look-up table indexed by the operation mode. With reference to FIG. 6D, the memory 508 may store a first look-up table 640 which contains table entries 642 with values 646 which represent respective frame rates (FR1 through $FR_N$) and indexed by indices 648 corresponding to respective operation modes (M1 through $M_N$) and, with reference to FIG. 6E, a second look-up table 650 which contains table entries 652 with values 654 which represent respective reference voltages (V1 through $V_N$) and indexed by indices 658 corresponding to the respective operation modes (M1 through $M_N$). Table entries 642 and 652 for correlated pairs of frame rate values 646 and reference voltage values 654 are both indexed by an index value representing the corresponding operation mode (e.g. M2). In this example, the frame rate circuit 504 may include a circuit to respond to a change from a current operation mode to a new operation mode to set the frame rate for the display in accordance with a value (e.g. FR2) of the table entry retrieved from the first look-up table 640 in accordance with an index value (e.g., M2) representing the new operation mode, and the reference voltage circuit 506 may include a circuit to respond to the change to the new operation mode to set the reference voltage for the display in accordance with a value (e.g. V2) of the table entry retrieved from the second look-up table 650 in accordance with the index value (e.g. M2) representing the new operation mode.

Figure 7:
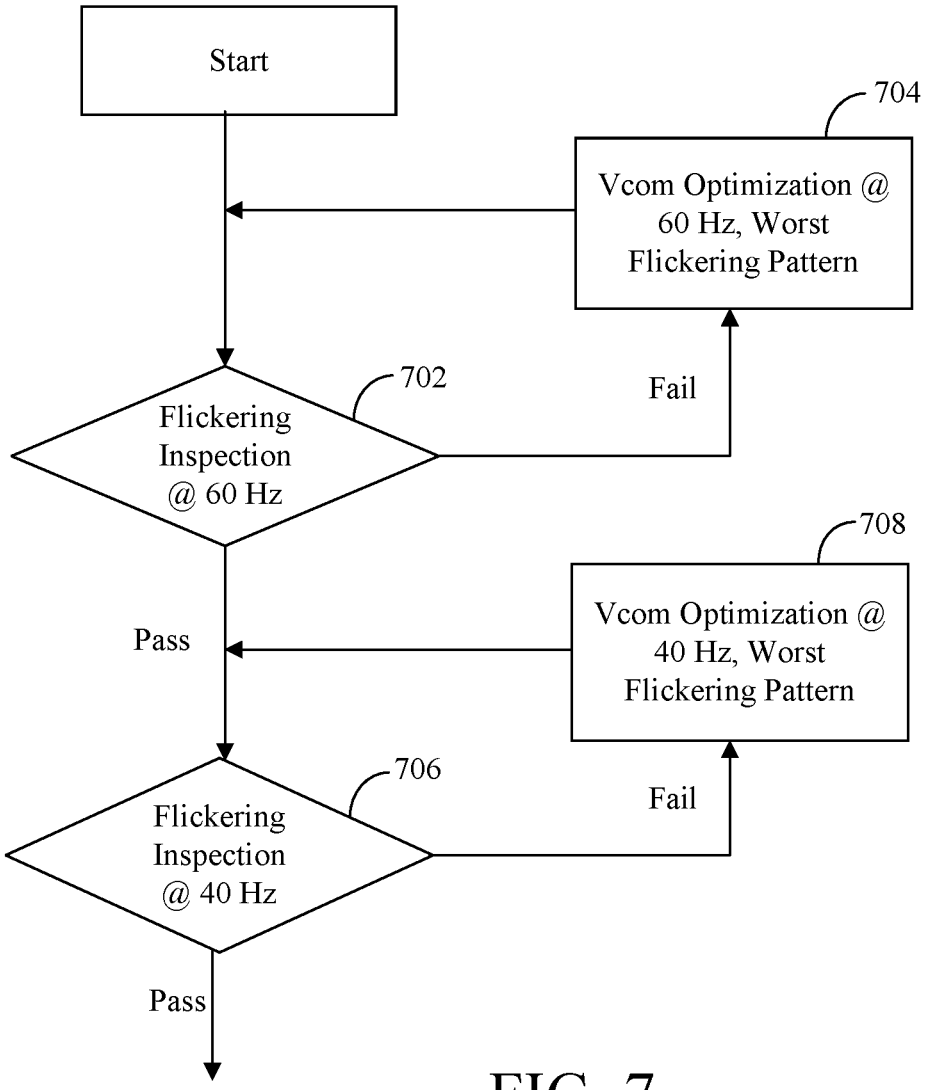
FIG. 7 is a flow chart of an example of a method of initializing a display system according to an embodiment.

Turning to FIG. 7, embodiments of a method of initializing a display system may include performing a flickering inspection at 60 Hz at block 702 (e.g. with a nominal or ideal Vcom). The illustrated method may be implemented in executable software as a set of logic instructions stored in a machine- or computer-readable medium of a memory such as random access memory (RAM), read only memory (ROM), programmable ROM (PROM), firmware, flash memory, etc., in configurable logic such as, for example, programmable logic arrays (PLAs), field programmable gate arrays (FPGAs), complex programmable logic devices (CPLDs), in fixed-functionality logic hardware using circuit technology such as, for example, application specific integrated circuit (ASIC), complementary metal oxide semiconductor (CMOS) or transistor-transistor logic (TTL) technology, or any combination thereof.

Illustrated processing block 702 determines whether the display system fails a flickering inspection at a default rate (e.g., at 60 Hz). If the display system fails the flickering inspection at 60 Hz, Vcom may be adjusted at block 704, wherein illustrated block 702 is repeated until the display system passes the flickering inspection at 60 Hz. For example, an image pattern may be selected for the flickering inspection which is known to involve flickering issues. When the display system passes the flickering inspection at 60 Hz, the method may further include saving the current Vcom as Vcom60. The method may further include performing a flickering inspection at 40 Hz at block 706 (e.g. with a nominal or ideal Vcom, or pre-determined offset from Vcom60). If the display system fails the flickering inspection at 40 Hz, adjusting Vcom at block 708 and repeating block 706 until the display system passes the flickering inspection at 40 Hz. When the display system passes the flickering inspection at 40 Hz, the method may further include saving the current Vcom as Vcom40.

The inspection may be a visual inspection and the adjusting may be an automated adjustment. For example, the inspection may be performed using a video camera, photodetector, or photosensor to measure flicker and the reference voltage may be incrementally adjusted up and/or down until no perceptible flicker is found, until the measured flicker is not visibly perceptible to the human eye, or until the observed flicker is determined to be the most acceptable across the range of voltage adjustment. Moreover, the method of initializing the display system may further include performing the flickering inspection and adjusting the Vcom for any number of refresh rates to store multiple reference voltages corresponding to multiple refresh rates for the display system. Alternatively, another physical measurement or detection may be utilized as a proxy for direct observation or measurement of flicker. Vcom values may be stored in display system hardware such as the EEPROM of FIG. 1. Alternatively, appropriate Vcom values may be stored in firmware, application software, operating system software, or edgeware.

Figure 8:
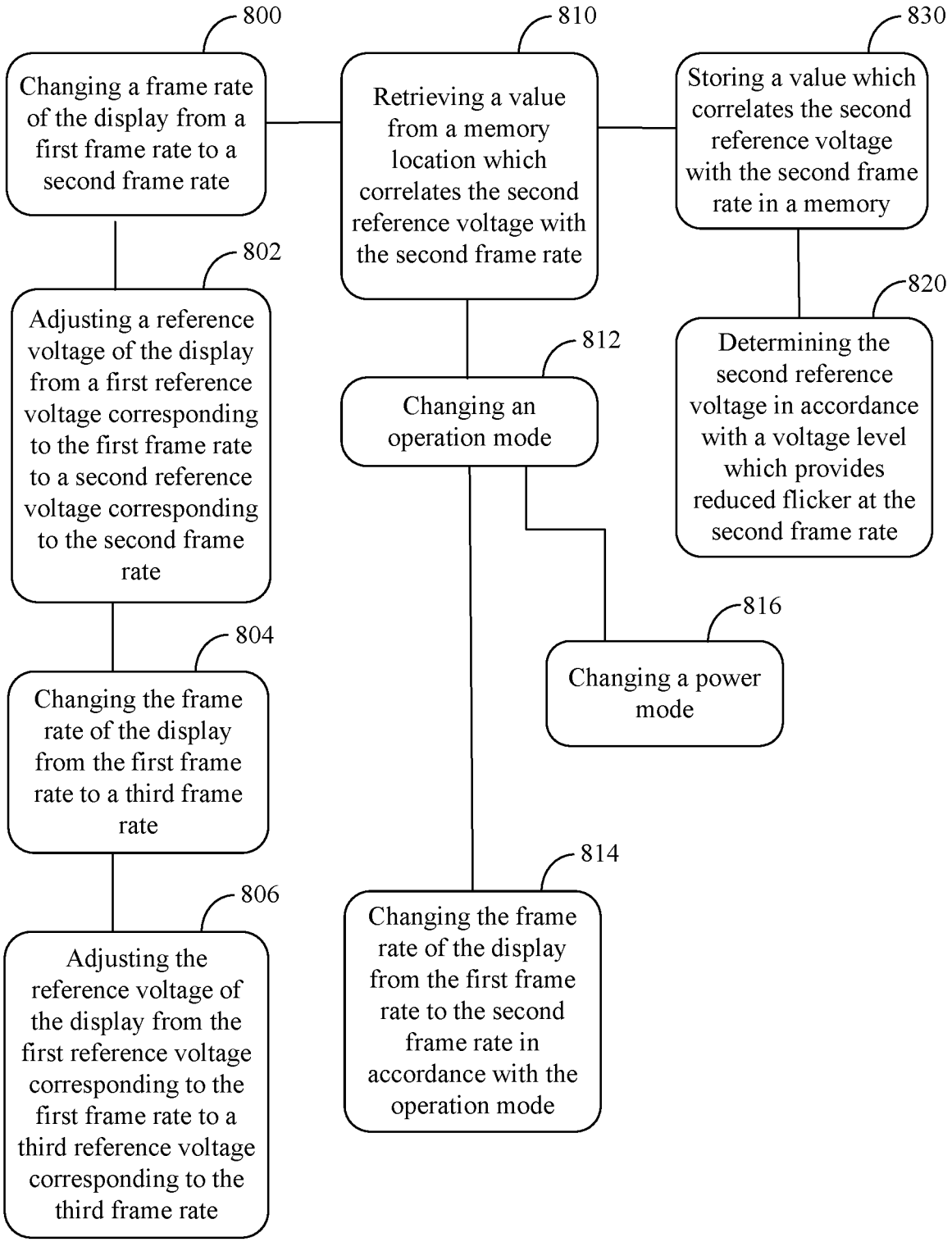
FIG. 8 is a flow chart of an example of a method of controlling a display according to an embodiment.

Turning to FIG. 8, embodiments of a method of controlling a display are shown. The illustrated method may be implemented in executable software as a set of logic instructions stored in a machine- or computer-readable medium of a memory such as RAM, ROM, PROM, firmware, flash memory, etc., in configurable logic such as, for example, PLAs, FPGAs, CPLDs, in fixed-functionality logic hardware using circuit technology such as, for example, ASIC, CMOS or TTL technology, or any combination thereof.

More particularly, the method may include changing a frame rate of the display from a first frame rate to a second frame rate at block 800, and adjusting a reference voltage of the display from a first reference voltage corresponding to the first frame rate to a second reference voltage corresponding to the second frame rate at block 802. For example, embodiments of the method of controlling the display may further include changing the frame rate of the display from the first frame rate to a third frame rate at block 804, and adjusting the reference voltage of the display from the first reference voltage corresponding to the first frame rate to a third reference voltage corresponding to the third frame rate at block 806.

Embodiments of the method of controlling the display may further include retrieving a value from a memory location which correlates the second reference voltage with the second frame rate at block 810. An embodiment may include changing an operation mode at block 812 and changing the frame rate of the display from the first frame rate to the second frame rate in accordance with the operation mode at block 814. For example, changing the operation mode may include changing a power mode at block 816.

Embodiments of the method of controlling the display may further include determining the second reference voltage in accordance with a voltage level which provides reduced flicker at the second frame rate at block 820. Embodiments may further include storing a value which correlates the second reference voltage with the second frame rate in a memory at block 830.

ADDITIONAL NOTES AND EXAMPLES

Example 1 includes a liquid crystal display system such as the system shown in FIG. 1 further including at least one non-volatile memory storing at least one look-up table with table entries and indices to correlate at least two of the frame rate, the reference voltage, and the operation mode.

For example, the table entries may contain values that represent respective reference voltages and wherein the table may be indexed by indices representing either the respective frame rates or operation modes. In this example, the timing control circuit may include a circuit to set a different frame rate for the liquid crystal display to one of the first frame and the second frame rate in accordance with a different operation mode, to retrieve a value representing the correlated reference voltage from the look-up table in accordance with either the different frame rate or operation mode, and to provide the retrieved value or correlated reference voltage to the power control circuit.

In another configuration of Example 1, the table entries may contain values that represent respective frame rates and wherein the table may be indexed by either the respective reference voltages or operation modes. In this example, the power control circuit may include a circuit to set a different reference voltage for the liquid crystal display to one of the first reference voltage and the second reference voltage in accordance with a different operation mode, to retrieve a value representing the correlated frame rate from the look-up table in accordance with either the different reference voltage or operation mode, and to provide the retrieved value or correlated frame rate to the timing control circuit.

In another configuration of Example 1, each of the timing and power control circuits has its own look-up table indexed by the operation mode. For example, the non-volatile memory may store a first look-up table which contains table entries which represent respective frame rates corresponding to respective operation modes and a second look-up table which contains table entries which represent respective reference voltages corresponding to the respective operation modes, and table entries for correlated pairs of frame rates and reference voltages are both indexed by an index value representing the corresponding operation mode. In this example, the timing control circuit may include a circuit to respond to a change from a current operation mode to a new operation mode to set the frame rate for the display in accordance with a value of the table entry retrieved from the first look-up table in accordance with an index value representing the new operation mode, and the power control circuit may include a circuit to respond to the change to the new operation mode to set the reference voltage for the display in accordance with a value of the table entry retrieved from the second look-up table in accordance with the index value representing the new operation mode.

In any of these examples for Example 1, the first reference voltage may correspond to a voltage which provides reduced flicker at the first frame rate and the second reference voltage may correspond to a voltage which provides reduced flicker at the second frame rate. Likewise, the operation mode may include any of a power mode, a gaming mode, a performance mode, a regular mode, a movie mode, a user selected mode, and a condition triggered mode.

Example 2 includes a processing system such as the system shown in FIG. 3 further including at least one non-volatile memory storing at least one look-up table with table entries and indices to correlate at least two of the frame rate, the reference voltage, and the operation mode.

For example, the table entries may contain values that represent respective reference voltages and wherein the table may be indexed by indices representing either the respective frame rates or operation modes. In this example, the timing control circuit may include a circuit to set a different frame rate for the liquid crystal display to one of the first frame and the second frame rate in accordance with a different operation mode, to retrieve a value representing the correlated reference voltage from the look-up table in accordance with either the different frame rate or operation mode, and to provide the retrieved value or correlated reference voltage to the power control circuit.

In another configuration of Example 2, the table entries may contain values that represent respective frame rates and wherein the table may be indexed by either the respective reference voltages or operation modes. In this example, the power control circuit may include a circuit to set a different reference voltage for the liquid crystal display to one of the first reference voltage and the second reference voltage in accordance with a different operation mode, to retrieve a value representing the correlated frame rate from the look-up table in accordance with either the different reference voltage or operation mode, and to provide the retrieved value or correlated frame rate to the timing control circuit.

In another configuration of Example 2, each of the timing and power control circuits has its own look-up table indexed by the operation mode. For example, the non-volatile memory may store a first look-up table which contains table entries which represent respective frame rates corresponding to respective operation modes and a second look-up table which contains table entries which represent respective reference voltages corresponding to the respective operation modes, and table entries for correlated pairs of frame rates and reference voltages are both indexed by an index value representing the corresponding operation mode. In this example, the timing control circuit may include a circuit to respond to a change from a current operation mode to a new operation mode to set the frame rate for the display in accordance with a value of the table entry retrieved from the first look-up table in accordance with an index value representing the new operation mode, and the power control circuit may include a circuit to respond to the change to the new operation mode to set the reference voltage for the display in accordance with a value of the table entry retrieved from the second look-up table in accordance with the index value representing the new operation mode.

In any of these examples for Example 2, the first reference voltage may correspond to a voltage which provides reduced flicker at the first frame rate and the second reference voltage may correspond to a voltage which provides reduced flicker at the second frame rate. Likewise, the operation mode may include any of a power mode, a gaming mode, a performance mode, a regular mode, a movie mode, a user selected mode, and a condition triggered mode.

Example 3 is an embodiment where a display controller for a display includes means for changing a frame rate of the display from a first frame rate to a second frame rate, and means for adjusting a reference voltage of the display from a first reference voltage corresponding to the first frame rate to a second reference voltage corresponding to the second frame rate. Example 3 may further include means for storing a first value which correlates the first reference voltage with the first frame rate in a first memory location, and a second value which correlates the second reference voltage with the second frame rate in a second memory location. In example 3, the first reference voltage may correspond to a voltage which provides reduced flicker at the first frame rate and the second reference voltage may correspond to a voltage which provides reduced flicker at the second frame rate.

Example 3 may further include means for changing the frame rate of the display from the first frame rate to the second frame rate in accordance with a change in an operation mode, and means for adjusting the reference voltage of the display from the first reference voltage to the second reference voltage in accordance with the change in the operation mode. For example, the change in the operation mode may correspond to a change in a power mode. Example 3 may further includes means for changing the frame rate of the display from the first frame rate to a third frame rate, and means for adjusting the reference voltage of the display from the first reference voltage corresponding to the first frame rate to a third reference voltage corresponding to the third frame rate.

Example 4 includes embodiments of a method of initializing a display, including operating the display at a first frame rate, determining a first reference voltage for the display which provides a reduced amount of display artifacts at the first frame rate, storing a correlation between the first frame rate and the first reference voltage in a first non-volatile memory location, operating the display at a second frame rate, determining a second reference voltage for the display which provides a reduced amount of display artifacts at the second frame rate, and storing a correlation between the second frame rate and the second reference voltage in a second non-volatile memory location. Example 4 may further include operating the display at a third frame rate, determining a third reference voltage for the display which provides a reduced amount of display artifacts at the third frame rate, and storing a correlation between the third frame rate and the second reference voltage in a third non-volatile memory location.

For example, embodiments of determining the respective reference voltages may include sweeping the reference voltage through a range of voltages and determining which voltage in the range of voltages provides a relatively lower amount of display artifacts as compared to other voltages in the range of voltages. For example, the display artifacts may include flicker and the respective reference voltages may be determined in accordance with a voltage which provides no visibly perceptible flicker by the human eye at the respective frame rates.

Example 5 includes a method of operating an electronic system which includes changing an operation mode for the electronic system from a current operation mode to a new operation mode, changing a frame rate of a display of the electronic system from a first frame rate to a second frame rate in response to changing to the new operation mode, and adjusting a reference voltage of the display from a first reference voltage to a second reference voltage in response to changing to the new operation mode. Example 5 may further include retrieving a value from a memory location which correlates the new operation mode with the second frame rate. Example 5 may further include retrieving a second value from a second memory location which correlates the second reference voltage with the second frame rate. Alternatively, example 5 may further include retrieving a value from a memory location which correlates the new operation mode with the second reference voltage. In any of these examples, changing the operation mode may include changing any of a power mode, a gaming mode, a performance mode, a regular mode, a movie mode, a user selected mode, and a condition triggered mode.

Example 6 is an embodiment of display controller (e.g. display controller 400) that does not include any memory or storage for correlating operation mode with the frame rate and the reference voltage. For example, if there are only two operation modes (e.g. regular mode and low power mode), the correlation may be made by a single mode enable line (or mode indication signal line) to cause the frame rate circuit to drive the display with the appropriate frame rate based on the state of the mode enable signal and the reference voltage circuit to provide the appropriate reference to voltage to the display based on the state of the mode enable signal. Likewise, if there are relatively few operating modes, frame rates, and/or reference voltages, discrete logic or circuits may be utilized to implement appropriate frame rate selection and reference voltage selection circuits.

Embodiments are applicable for use with all types of semiconductor integrated circuit ("IC") chips and discrete circuit components. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrases "one or more of A, B or C" may mean A, B, C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. A liquid crystal display system, comprising:

a liquid crystal display panel;

a source driver circuit coupled to the liquid crystal display panel;

a gate driver circuit coupled to the liquid crystal display panel;

a display connector;

a back light disposed adjacent to the liquid crystal display panel;

a back light driver circuit coupled between the display connector and the back light;

a timing control circuit coupled between the display connector and the source driver circuit, the timing control circuit to set a frame rate of the liquid crystal display panel to one of at least a first frame rate and a second frame rate in accordance with an operation mode; and a power control circuit coupled between the display connector and the gate driver circuit, the power control circuit to automatically set a reference voltage of the liquid crystal display panel to one of at least a first reference voltage and a second reference voltage in accordance with the operation mode to symmetrically balance a total amount of positive and negative pixel voltage polarities and to reduce flicker when the frame rate is changed, wherein the first reference voltage and the second reference voltage are to be set to a corresponding voltage to reduce or remove flicker in the associated operation mode, and wherein the first reference voltage corresponds to a first pre-determined voltage for the first frame rate and the second reference voltage corresponds to a second pre-determined voltage for the second frame rate.

2. The liquid crystal display system of claim 1, further comprising: a non-volatile memory storing at least a first value which correlates the first reference voltage with the first frame rate and at least a second value which correlates the second reference voltage with the second frame rate.

3. The liquid crystal display system of claim 2, wherein the timing control circuit includes a frame rate circuit to set a different frame rate for the liquid crystal display to one of the first frame and the second frame rate in accordance with a change in the operation mode, to retrieve one of the first value and the second value from the non-volatile memory in accordance with the different frame rate, and to provide the retrieved value to the power control circuit.

4. A processing system comprising;

a processor;

a display coupled to the processor; and a display controller coupled to the display, wherein the display controller includes:

a frame rate circuit to change a frame rate of a display from a first frame rate to a second frame rate, wherein the frame rate circuit is further to change the frame rate of the display from the first frame rate to the second frame rate in accordance with a change in an operation mode, and a reference voltage circuit to automatically adjust a reference voltage of the display from a first reference voltage corresponding to the first frame rate to a second reference voltage corresponding to the second frame rate to symmetrically balance a total amount of positive and negative pixel voltage polarities and to reduce flicker when the frame rate is changed, wherein the first reference voltage and the second reference voltage are to be set to a corresponding voltage to reduce or remove flicker in the associated operation mode, and wherein the first reference voltage corresponds to a first pre-determined voltage for the first frame rate and the second reference voltage corresponds to a second pre-determined voltage for the second frame rate.

5. The processing system of claim 4, wherein the display controller further comprises:

a memory storing a first value which correlates the first reference voltage with the first frame rate in a first memory location and a second value which correlates the second reference voltage with the second frame rate in a second memory location.

6. The processing system of claim 4, wherein the change in the operation mode corresponds to a change in a power mode.

7. The processing system of claim 4, wherein the frame rate circuit is further to change the frame rate of the display from the first frame rate to a third frame rate, and wherein the reference voltage circuit is further to adjust the reference voltage of the display from the first reference voltage corresponding to the first frame rate to a third reference voltage corresponding to the third frame rate.

8. The processing system of claim 4, wherein the display comprises a liquid crystal display and wherein the reference voltage corresponds to a common voltage for the liquid crystal display.

9. A display controller comprising:

a frame rate circuit to change a frame rate of a display from a first frame rate to a second frame rate, wherein the frame rate circuit is further to change the frame rate of the display from the first frame rate to the second frame rate in accordance with a change in an operation mode; and a reference voltage circuit to automatically adjust a reference voltage of the display from a first reference voltage corresponding to the first frame rate to a second reference voltage corresponding to the second frame rate to symmetrically balance a total amount of positive and negative pixel voltage polarities and to reduce flicker when the frame rate is changed, wherein the first reference voltage and the second reference voltage are to be set to a corresponding voltage to reduce or remove flicker in the associated operation mode, and wherein the first reference voltage corresponds to a first pre-determined voltage for the first frame rate and the second reference voltage corresponds to a second pre-determined voltage for the second frame rate.

10. The display controller of claim 9, further comprising:

a memory storing a first value which correlates the first reference voltage with the first frame rate in a first memory location, and a second value which correlates the second reference voltage with the second frame rate in a second memory location.

11. The display controller of claim 9, wherein the change in the operation mode corresponds to a change in a power mode.

12. The display controller of claim 9, wherein the frame rate circuit is further to change the frame rate of the display from the first frame rate to a third frame rate, and wherein the reference voltage circuit is further to adjust the reference voltage of the display from the first reference voltage corresponding to the first frame rate to a third reference voltage corresponding to the third frame rate.

13. A method of controlling a display, comprising:

changing, via a frame rate circuit, a frame rate of the display from a first frame rate to a second frame rate, wherein changing the frame rate includes:

changing an operation mode; and changing the frame rate of the display from the first frame rate to the second frame rate in accordance with the operation mode; and automatically adjusting, via a reference voltage circuit, a reference voltage of the display from a first reference voltage corresponding to the first frame rate to a second reference voltage corresponding to the second frame rate to symmetrically balance a total amount of positive and negative pixel voltage polarities and to reduce flicker when the frame rate is changed, wherein the first reference voltage and the second reference voltage are to be set to a corresponding voltage to reduce or remove flicker in the associated operation mode, and wherein the first reference voltage corresponds to a first predetermined voltage for the first frame rate and the second reference voltage corresponds to a second predetermined voltage for the second frame rate.

14. The method of claim 13, further comprising:

retrieving a value from a memory location which correlates the second reference voltage with the second frame rate.

15. The method of claim 13, wherein changing the operation mode comprises changing a power mode.

16. The method of claim 13, further comprising:

changing the frame rate of the display from the first frame rate to a third frame rate; and adjusting the reference voltage of the display from the first reference voltage corresponding to the first frame rate to a third reference voltage corresponding to the third frame rate.

17. The method of claim 13, further comprising:

determining the second reference voltage in accordance with a voltage level which provides reduced flicker at the second frame rate.

18. The method of claim 17, further comprising:

storing a value which correlates the second reference voltage with the second frame rate in a memory.

* * * * *